United States Patent [19]

O'Donnell

[11] Patent Number: 4,516,799

[45] Date of Patent: May 14, 1985

[54] SNOW REMOVAL DEVICE

[76] Inventor: Brian C. O'Donnell, 172 Courtenay La., Schaumburg, Ill. 60193

[21] Appl. No.: 589,947

[22] Filed: Mar. 15, 1984

[51] Int. Cl.[3] ..... E01H 5/02

[52] U.S. Cl. ..... 294/54.5

[58] Field of Search ..... 294/54.5, 49, 55, 51, 294/52, 53, 58; 39/53, 41, 162, 130, 134

[56] References Cited

U.S. PATENT DOCUMENTS 543,910 8/1895 Torr ..... 294/54.5

2,958,143 11/1960 Bonic ..... 294/54.5

3,035,816 5/1962 Conant ..... 294/54.5

*Primary Examiner*—James B. Marbert

*Attorney, Agent, or Firm*—Leo J. Aubel; Ralph R. Rath

[57] ABSTRACT

A snow removal implement includes a polygonal main body having a scraping edge at one end and a hand gripping means adjacent an opposite end with a foot engageable means intermediate opposite ends so that the operator can be in a generally upright position and use leg power rather than back muscles for manipulation.

8 Claims, 5 Drawing Figures

FIG. 1
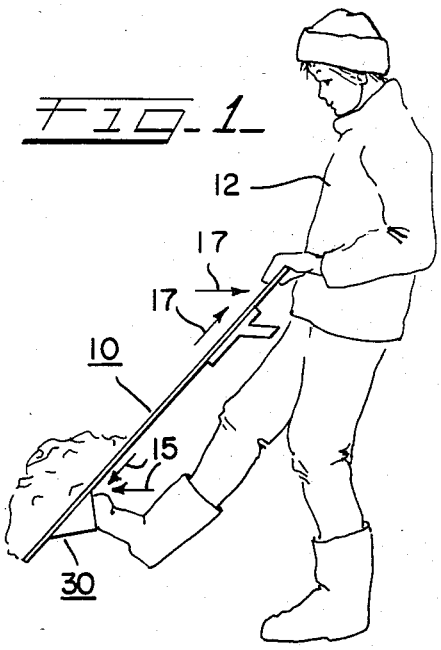
FIG. 2
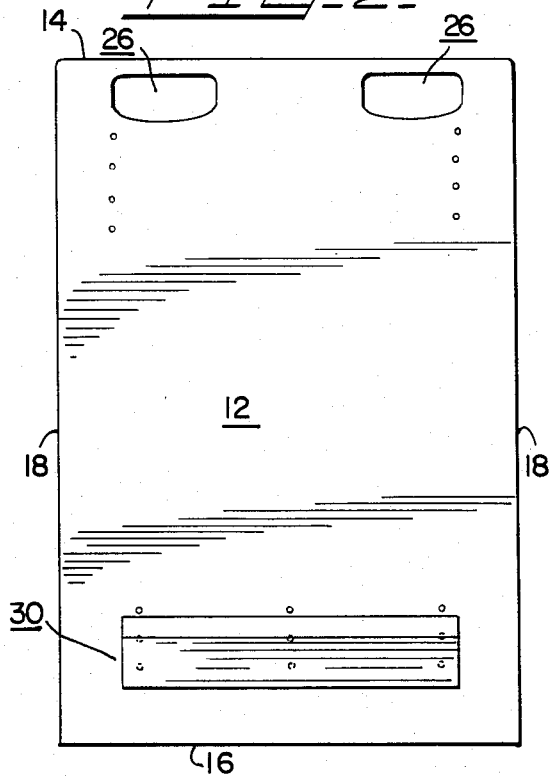
FIG. 5
$\ell \times \omega = L \times W$
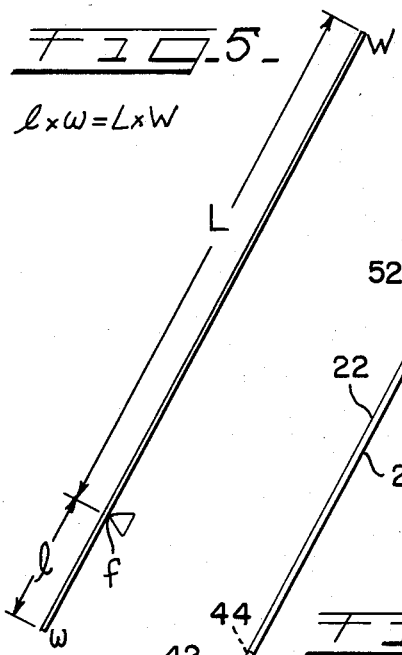
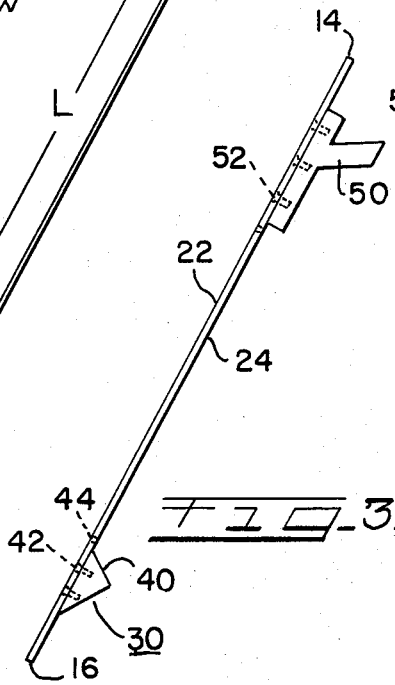
FIG. 3
FIG. 4
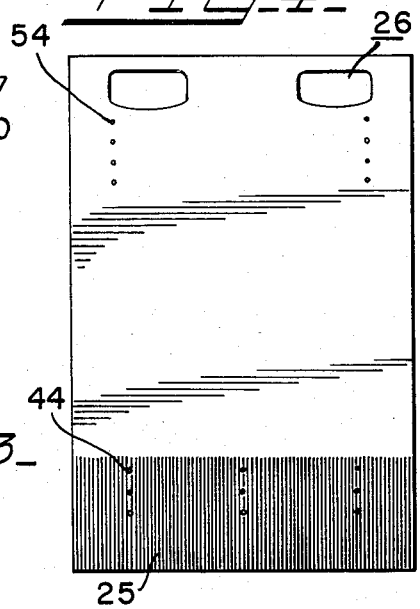

SNOW REMOVAL DEVICE

DESCRIPTION

1. Technical Field

The present invention relates generally to snow removal equipment and, more particularly, to a hand operated snow removal device.

2. Background Prior Art

Snow removal devices, particularly for the homeowner, have been in existence for decades. The most common type of snow removal equipment still consists of a shovel having a scraping and lifting end attached to a handle which the operator can grasp to remove snow from a desired area, such as a driveway or a sidewalk.

The removal of snow is an overly exerting job that, to many, particularly the elderly, is also a serious health hazard. Numerous injuries and deaths are reported annually resulting from a homeowner either straining his back or experiencing a heart attack as a result of the over-exertion from the continual bending and lifting of the snow for removal from the desired area.

In recent years, snow blowers have been developed which are easy to manipulate and which considerably reduce the amount of exertion necessary for the removal of snow. While such devices are decidedly satisfactory for the intended purpose, the initial cost thereof is high and the operational costs for fuel and repair many times make such an item a luxury for the normal homeowner. Furthermore, snow blowers are difficult to store because of their bulky nature and require additional storage capacity for fuel. The fuel, including the gasoline and the oil, is highly combustible and creates a fire hazard, particularly when excessive fuel remains after the end of the winter season.

Because of the overall cost of snowblowing devices, and the inconvenience resulting therefrom, and also the safety hazards particularly for younger users and for the elderly, many homeowners still utilize the convetional shovel for removing snow when necessary. Many prior art devices have been proposed as substitutes for the standard shovel that still is the mandatory item for any homeowner. For example, U.S. Pat. No. 4,245,411 discloses a scoop-type snow scraper/lifter so that theoretically the user utilizes hips and other body actions for urging of the unit along a surface where snow is to be removed. The unit disclosed in this patent is designed to reduce the strain experienced by a user during normal snow removal by being configured to allow the user to pivot the unit on one knee and press down on the gripping devices to raise the snow off the ground and move it to an accumulation area.

Basically the principal problem inherent in the manual scoop-type snow pusher/lifter disclosed in the above-mentioned patent appears to be that it just does not function satisfactorily as a snow removal device. More specifically, its reliance on the knee joint as a fulcrum is an inherently dangerous injury hazard. The knee joint is one of the most sensitive and unstable joints in the human body. Additionally, the twisting and turning of the knee and foot in the snow removing action as taught by the prior art structure also produces an unwanted injury hazard.

Thus, there remains a need an effective manual snow removal device that allows the operator to remain in a generally upright position throughout the snow removal process. The foregoing reduces the upper back strain normally encountered during bending over and lifting of the snow which is inherent when using a conventional snow shovel.

SUMMARY OF THE INVENTION

According to the present invention, a simplified snow removal device has been developed which can be mass produced at a minimum cost, and that requires a minimal amount of storage area. Most importantly, the inventive snow removal implement allows the operator to remain in a generally upright position at all times without producing any excessive and unusual muscle strain on the back muscles and the vertebrae which heretofore has been the most common injury resulting from snow removal.

More specifically, the present invention consists of a generally flat polygonal member that has a flat scraping edge at one lower end. Gripping means are formed adjacent an upper end of the member which is adapted to be normally maintained at an angular position with the scraping edge in sliding engagement with a surface from which snow is to be removed. Thus, the operator can move snow along the surface while moving in a generally upright position. Any snow that is accumulated on the device during the sliding or scraping movement can easily be moved forward and outwardly of the user or operator by, utilizing the legs, again in a fully extended position while the back is in a generally upright position to reduce strain. The device is designed to maximize the leverage of the operator during the moving and lifting of the snow to a desired spot.

In the more specific embodiment, the device consists of a generally rectangular one-piece member that has a linear scraping edge at one end thereof, which may be sharpened to a finer edge, and has a gripping means in the form of openings adjacent the upper end thereof that are spaced approximately equal to the normal width of an operator so that the operator's hands are in a normal unstrained extended position during use.

According to the primary aspect of the present invention, the snow removal device has a foot engageable means or kick plate which is located in fairly close proximity to the scraping edge of the snow removal device and is a substantial distance from the gripping end. The operator can thus place his foot on the kick plate while the rest of the leg is in a generally fully extended position to maximize the lifting force and minimize straining of any muscles during actual lifting and removal of the snow from the desired area, as will be explained more fully hereinbelow.

In the specific embodiment illustrated, the snow removal device is preferably a molded, one-piece plastic member, such as a polystyrene polyurethene or other easily molded strong plastic rugged material that will withstand the rigors of extended use and variation in temperature and, at the same time, does not cause the snow to stick to its surface. It has been found that a plastic with a lightly grazed or vertically extending grooves in the front or snow contacting surface enables the snow to move off of the surface somewhat more readily than from a smooth surface.

The rectangular, preferably molded member has a substantially uniform cross-sectional thickness throughout its length thereof and is generally flat between opposite lateral edges. This has the advantage of minimizing the space required for storage since the unit can easily be hung on one or two nails along the wall of a homeowner's garage.

In the preferred embodiment, the kick plate is in the form of a triangular member that has three generally flat sides and is releasably secured to the main body through fasteners, such as conventional screws, extending through a set of openings in the body member. A plurality of sets of openings are preferably provided so that the kick plate can be adjusted to fit the normal height and dimensions of an operator.

The hand gripping means may also consist of a pair of handles, such as the conventional pistol-grip handles, which can easily be attached adjacent the upper end of the main body through releasable fasteners and a plurality of sets of holes to accommodate adjustment for operators or users of different heights.

BRIEF DESCRIPTION OF SEVERAL VIEWS OF DRAWINGS

FIG. 1 discloses the snow removal device constructed in accordance with the present invention being used by an operator for the removal of snow;

FIG. 2 is a rear view of the details of construction of the snow removal device;

FIG. 3 is a side elevation of the device shown in FIG. 2;

FIG. 4 is a front plan view of the snow removal device; and,

FIG. 5 is a view similar to FIG. 3 showing the relationship of the fulcrum and reaction forces during normal use of the snow removal device.

DETAILED DESCRIPTION

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

FIG. 1 of the drawings discloses a snow removal implement or device, generally designated by reference numeral 10, in the normal operating position and being manipulated by an operator 12. Note that the operator is handling and using the snow removal implement while in a position wherein his back is generally vertical and straight, as will be explained hereinafter.

The details of the snow removal implement or device 10 are illustrated in FIGS. 2, 3 and 4 and consist of a generally polygonal main body 12 that has an upper end or edge 14 and a lower end or edge 16. The snow removal implement also has substantially linear opposed lateral edges 18 that extend between the upper edge 14 and the lower edge 16. The rectangular main body 12 has a substantially uniform cross-sectional thickness through its length between upper and lower ends 14 and 16, as well as between lateral edges 18 as shown in FIG. 3 and has a generally flat front surface 22 and back surface 24.

Gripping means are provided adjacent the upper end 14, and in the illustrated embodiment, one type of gripping means is shown as including a pair of elongated openings 26 which are formed directly in the main body 12 adjacent the upper edge and have a configuration that conforms generally to receiving an operator's hand. The spacing of the openings 26 is such that the operator has his arms extending generally downwardly in a comfortable transverse spacing.

According to a primary aspect of the present invention, the snow removal device incorporates a foot engageable means or kick plate 30 adjacent the lower scraping edge 16 and the kicking means 30 is preferably removably secured to the rear surface 24 to allow the front surface 22 to remain substantially unobstructed. The kick means is in the form of a generally polygonal or triangular plate having a plurality of flat sides 40 providing a substantially flat surface. As seen in FIG. 1, the sides 40 of triangular kick plate 30 provide a surface for engagement by the foot of the operator or user which extends at a sharp angle from the surface 24 thereby providing a defined surface against which the operator can apply the force of his foot. The kick means or kick plate 30 is releasably secured to main body 12 through releasable fasteners or screws 42 extending through holes 44. Screws 42 may be of the flathead variety. Preferably, there are a plurality of sets of holes 44 (FIG. 4) so that the kick plate 30 can be vertically adjusted between upper and lower ends 14, 16.

The gripping means may alternatively or additionally include pistol-type gripping handles, such as illustrated at 50 in FIG. 3. The gripping handles 50 are releasably secured to main body 12 through releasable fasteners 52 extending through holes 54 in the main body. A plurality of sets of holes 54 are preferably formed in the main body 12 to provide vertical adjustment of handles 50.

The use of the manual snow removal device or implement is apparent from the above description. During removal of a light accumulation of snow, the operator can grip the upper end of the snow removing equipment through gripping openings 26, which are spaced to position the hands at approximately waist level outside the waist in a comfortable position. A push force can then be exerted to move snow while the back is in a generally upright position to reduce back muscle strain.

When manipulating the implement in a heavier accumulation of snow, the implement is preferably gripped either by the openings 26 or handles 50, whichever is most comfortable for the operator, and the lower edge 16 is pushed along the surface.

After an amount of snow has been accumulated on the front surface 22, it becomes necessary to cast the accumulation forward. With the implement constructed in accordance with the teachings of the present invention, this is accomplished by placing one foot on the kick plate 30 with the leg in the extended position illustrated in FIG. 1 and the back in an upright position and an outward pushing or kicking force of the foot is applied using maximum leg strength and the resulting force is applied as a vertical component and a horizontal component. The two components produce a resultant force to move the lower portion of the implement about the reaction point located at the operator's hands on the upper end of the implement. Since the kick plate 30 is substantially closer to the lower end of the implement than the upper end, the force of the foot will be amplified several times in relation to the fulcrum point.

FIG. 5 shows this amplification wherein (w) and (W) are respectively total weights of the implement and the accumulated snow below and above the fulcrum point (f) where the kicking force is applied. In the illustrated embodiment, the distance (L) above the fulcrum point (f) is several times greater than the distance (l) below the fulcrum point (f). In the specific embodiment illustrated, the distance (L) is about four times greater than the distance (l). This relationship can be varied by using and adjusting handles 50 and kick plate 30 accordingly and these same adjustments can be used to adjust the implement for operators of different heights and still work in a generally right position.

Note also that for the lifting and removal of the heavier snow loads, and as indicated in FIG. 1, by arrows 15 and 17 respectively, the user pulls upwardly and backwardly on the grips holes 26 or handles 50 (thus not bending his back), and pushes downwardly and forwardly with his foot against the kick plate 30 and thereby lifts the load of snow. Kick plat 30 is thus important, to effect the foregoing, snow lifting and removal action.

Note further that in operating or using the inventive snow removal implement the body, legs and arms push forwardly. The feet of the user are planted firmly, there is no twisting or turning action of the feet, or the legs or arms. The legs operate in a bending forward movement in a natural body movement. All this, of course, reduces strain to the back, legs and arms of the user.

The snow removing implement of the present invention is inexpensive to manufacture, can be shipped in a flat condition and can easily be assembled. Also, the main body, kick plate and handles can be molded in one-step molding operations durable polyurethane, to which snow will not stick. In certain instances, grooves 25 may be provided in the snow-contacting surface to aid in snow removal.

Of course, the dimensions of the components can easily be varied to suit a particular market to accommodate average heights of people in that market. While the recommended construction material has been described as plastic, it could also be metal, such as aluminum, or natural or synthetic wood.

I claim:

1. A snow removal device operable by a user while maintaining the user's back in a generally upright position for reducing strain on the back muscles during snow removal, comprising a generally flat polygonal member having a scraping edge at a lower end thereof, gripping means adjacent an upper end of said member, said member adapted to be normally maintained at an angular position with the scraping edge in sliding engagement with a surface from which snow is being removed and a polygonal kick plate releasably secured to said member between said scraping edge and said upper end and being positioned substantially closer to said scraping edge than said upper edge so that a user's foot can engage said kick plate and produce a substantial force forwardly and outwardly on said member as said member is pulled backwardly and upwardly by said gripping means for removing the snow accumulated by said scraping edge and said device, said polygonal member having a plurality of sets of holes with fasteners extending through said holes and said polygonal kick plate so that said kick plate can be secured to said member in a plurality of adjusted positions using different sets of holes.

2. A snow removal device as defined in claim 1, in which the spacing between said kick plate and said upper end is several times greater than the spacing between said kick plate and said scraping edge.

3. A snow removal device as defined in claim 1, in which said polygonal member has elongated openings adjacent said upper end defining said gripping means.

4. A snow removal device as defined in claim 1, in which said gripping means includes spaced handles secured to said polygonal member adjacent said upper end.

5. A snow removal device as defined in claim 4, in which said polygonal member has a plurality of sets of apertures progressively spaced from said upper end and said handles have fasteners received into respective sets of apertures for adjustably positioning said handles with respect to said upper end.

6. A manual snow removing implement comprising a front flat surface adapted to be pushed against the snow with the lower portion of the front surface engaging the snow, the upper portion of said implement adapted to be held by the operator, a back surface for said implement, and a kick plate located adjacent the lower portion of the back surface, said kick plate being fixed to said back surface and engageable directly by the foot of the operator to provide a fulcrum point for a leveraged forward and upward movement of a load of snow.

7. An implement as in claim 6 wherein said kick plate enables the operator to push with his foot against the kick plate to thereby push forward and outwardly, and further including means at the upper portion of the implement for enabling the operator to pull upwardly and toward himself concurrently as he is pushing forwardly and outwardly with his foot to lift a load of snow without bending the operator's back or lifting with the operator's back muscles.

8. A snow removal device operable by a user while maintaining the user's back in a generally upright position for reducing strain on the back muscles during snow removal, comprising a generally flat polygonal member having a scraping edge at a lower end thereof, gripping means adjacent an upper end of said member, said member adapted to be normally maintained at an angular position with the scraping edge in sliding engagement with a surface from which snow is being removed and a kick plate secured directly to said member between said scraping edge and said upper end and being positioned substantially closer to said scraping edge than said upper edge, said kick plate having a surface engageable directly by a user's foot to produce a substantial force forwardly and outwardly on said member as said member is pulled backwardly and upwardly by said gripping means for removing the snow accumulated by said scraping edge and said device.

* * * * *